United States Patent [19]

Baxter

[11] Patent Number: 4,950,416

[45] Date of Patent: Aug. 21, 1990

[54] LIQUID DISHWASHER DETERGENT COMPOSITION

[75] Inventor: Steven L. Baxter, Ponca City, Okla.

[73] Assignee: Vista Chemical Company, Houston, Tex.

[21] Appl. No.: 259,857

[22] Filed: Oct. 19, 1988

[51] Int. Cl.[5] ..... C11D 7/16; C11D 7/56

[52] U.S. Cl. ..... 252/99; 252/97; 252/116; 252/173; 252/174.25; 252/315.4; 252/315.7; 252/DIG. 14

[58] Field of Search ..... 252/95, 97, 135, 116, 252/131, 99, DIG. 14, 173, 315.4, 315.7

[56] References Cited

U.S. PATENT DOCUMENTS

| | | | |
|---|---|---|---|
| 4,431,559 | 2/1984 | Ulrich | 252/99 |
| 4,508,634 | 4/1985 | Elepano et al. | 252/163 |
| 4,511,487 | 4/1985 | Pruhs et al. | 252/99 |
| 4,512,908 | 4/1985 | Heile | 252/160 |
| 4,599,186 | 7/1986 | Choy et al. | 252/102 |
| 4,657,692 | 4/1987 | Choy et al. | 252/99 |
| 4,695,394 | 9/1987 | Choy et al. | 252/97 |
| 4,750,942 | 6/1988 | Van Dijk et al. | 134/25.2 |
| 4,857,226 | 8/1989 | Drapier et al. | 252/174.25 |

FOREIGN PATENT DOCUMENTS

| | | |
|---|---|---|
| 2116199 | 9/1983 | United Kingdom . |
| 2140450 | 11/1984 | United Kingdom . |
| 2176495 | 12/1986 | United Kingdom . |
| 2185037 | 7/1987 | United Kingdom . |

*Primary Examiner*—Prince E. Willis

*Attorney, Agent, or Firm*—Browning, Bushman, Anderson & Brookhart

[57] ABSTRACT

The present invention is directed to an improved automatic dishwashing detergent composition. More particularly, the present invention comprises an aqueous, thixotropic automatic dishwasher composition containing a thickener comprised of an aqueous alumina dispersion and a stabilizer selected from the group consisting of a long chain fatty acid, the metal salt of a long chain fatty acid and mixtures thereof.

16 Claims, No Drawings

LIQUID DISHWASHER DETERGENT COMPOSITION

BACKGROUND OF THE INVENTION

1. Field of the Invention

The present invention relates to automatic dishwashing detergent compositions and, more particularly, to liquid automatic dishwashing detergent compositions which are thixotropic and have improved cup retention ability.

2. Description of the Background

Powdered, automatic dishwasher detergents suffer from several disadvantages such as non-uniform composition, a tendency to cake resulting in the formation of lumps which are difficult to disperse, dustiness (and the associated complications for users with allergies), and costly manufacturing techniques.

Automatic dishwasher detergent liquids (ADL's), while they overcome many of the problems noted above with respect to powdered automatic dishwasher detergents, suffer from their own disadvantages. In particular, one of the more serious problems encountered in the use of ADL's is that of poor cup retention. Cup retention refers to the tendency of the ADL to remain in a closed dispensing cup inside the dishwasher during the pre-wash cycle. Most automatic dishwashers have two dispensing cups for dishwasher detergent. The first cup is generally an open cup, whose contents are immediately contacted with the wash water upon initiation of the wash cycle. The second cup is closed in some fashion and is opened automatically at a desirable point later in the wash cycle. In most existing automatic dishwashers, the closure mechanism on the second cup has been designed for powdered formulations, and this mechanism often lacks a seal sufficient to contain a highly fluid formulation. Moreover, even when a seal is present, in older model dishwashers the seal mechanism is often worn. Consequently, the performance of many ADL formulations in dishwashers present in many consumers' homes has been heavily influenced by the rheological properties which control cup retention. Where these rheological properties are not adequately designed, most of the ADL is lost in the first wash cycle which results in inadequate washing during the second wash cycle when normally the ADL contained in the second cup would be dispensed. The further complication of this premature leaking of the ADL out of the dispensing cup is that residual surfactant which is intended to carry over into the rinse cycle as a rinse aid is lost during the first wash cycle. Thus, the consumer experiences inadequate cleaning due to the lack of detergent during the second wash cycle and spotting of glassware because of insufficient residual concentrations of rinse aid during the rinse cycle.

Manufacturers of ADL's have attempted to design the rheology of the formulation to provide a gel-like consistency when quiescent to improve cup retention. To this end, natural clays have typically been used at levels of about 3% by weight in order to provide the rheology required. The clays which are employed, e.g., the smectite clays, including montmorillonite (bentonite), are costly, especially when obtained in a pure, low color form. Further, since these clays are mined from naturally occuring deposits, there is also a problem with uniformity of available materials.

Aqueous dispersions of boehmite alumina have been used as thickeners in various formulations. However, it has not been proposed to use alumina as a thickener in ADL's since it was believed that the other components present in ADL's inhibit the thickening behavior of the alumina dispersion.

British Patent No. 2,176,495 discloses a thixotropic dishwasher detergent composition which employs clay or a similar material as a thixotropic thickener and the polyvalent metal salt of a long chain fatty acid as an additive to provide physical stability in terms of resistance to phase separation and settling.

It would be clearly desirable to provide an ADL which utilized less expensive, chemically uniform alumina of high whiteness as a thickener rather than more expensive, offcolor clays currently used.

SUMMARY OF THE INVENTION

It is therefore an object of the present invention to provide an improved thixotropic automatic dishwasher detergent.

Still a further object of the present invention is to provide an improved thixotropic automatic dishwasher liquid which shows excellent cup retention properties.

The above and other objects of the present invention will become apparent from the drawing, the description given herein and the appended claims.

In one respect, the objects noted above are achieved by a thixotropic, automatic dishwasher liquid containing a thickener comprised of an aqueous alumina dispersion and a stabilizer selected from the class consisting of a long chain fatty acid, a metal salt of a long chain fatty acid and mixtures thereof.

In another respect, the present invention provides an improvement in a thixotropic, automatic dishwasher liquid which contains an alkali metal polyphosphate, sodium silicate, a chlorine bleach stable, water-dispersible organic detergent active material and a chlorine bleach compound, the improvement comprising a thickener comprised of an aqueous alumina dispersion and a stabilizer selected from the class consisting of a long chain fatty acid, a metal salt of a long chain fatty acid and mixtures thereof.

BRIEF DESCRIPTION OF THE DRAWING

The FIGURE is a graph illustrating rheological comparisons of ADL's in accord with the present invention with comparative ADL's.

DESCRIPTION OF THE PREFERRED EMBODIMENT

ADL's generally contain an alkali metal polyphosphate, such as sodium triphosphate, which serves as a softener in hard water and an emulsifier or peptizer for soil, sodium silicate to supply alkalinity necessary for effective detergency, sodium carbonate, which is generally optional, to enhance alkalinity, a chlorine releasing agent or chlorine bleach compound to aid in the elimination of soil specs which lead to water spotting, water-dispersible organic detergent active material which will reduce foam, thereby enhancing machine efficiency while supplying requisite detergency, and detergent active material, i.e., the defoamer/surfactant, also serving as a rinse agent. Optionally, but preferably, ADL's also contain alkali metal hydroxides, such as sodium hydroxide, to enhance alkalinity and a chlorine bleach stable foam depressant. Many compositions omit hypochlorite bleach since it tends to react with other chemically active ingredients, particularly surfactants, thereby degrading the suspending or thixotropic agent and impairing its effectiveness. This problem can be largely overcome by employing as the surfactant a chlorine bleach stable, water-dispersible organic detergent active material.

The thickeners used in the compositions of the present invention are slurries or dispersions of aluminas, particularly boehmite aluminas, in an aqueous medium, particularly deionized water. Such aqueous dispersions or slurries can be formed by methods, such as disclosed in U.S. Pat. Nos. 4,746,503 or 4,676,928, incorporated herein by reference. Generally speaking, the alumina dispersions contain water, preferably deionized water, and boehmite alumina and optionally, depending on the method of forming the dispersion, a peptizing agent, e.g., a monovalent acid, such as nitric acid, hydrochloric acid, formic acid or acetic acid. Other peptizing agents that may be employed include salts of monovalent acids, e.g., aluminum nitrite, aluminum chloride, ferric nitrite or ferric chloride. Generally speaking, the alumina dispersion will contain from about 10% to about 20% by weight alumina depending upon the method of forming the dispersion, the particular type of alumina employed and the desired viscosity of the alumina dispersion. The dispersion will generally be present in the composition in an amount of from about 15% to about 35% by weight.

The alkali metal polyphosphates, e.g., tripolyphosphate, employed in the compositions of the present invention will generally be present in a range of from about 8% to about 35% by weight, preferably from about 10% to about 25% by weight, and should preferably be free of heavy metals which tend to decompose or inactivate the chlorine bleach compounds employed. The alkali metal polyphosphates may have an average degree of hydration of less than about 1 or more than about 5, e.g., from about 0% to about 2.7% by weight, or at least 16.5% of water, including the stable hexahydrate, with a degree of hydration of 6 corresponding to about 18% by weight of water or more. Actually, humidification to an average of about 0.3% to 1% water is highly effective, serving, it is thought, to form seeds of the stable hexahydrate which expedites hydration and solublization of the remaining polyphosphate particles.

The sodium silicate, which provides alkalinity and protection of hard surfaces such as fine china, glaze and pattern, is employed in an amount ranging from about 2.5% to about 20% by weight, preferably from about 5% to about 18% by weight in the composition. The sodium silicate is generally added in the form of an aqueous solution, preferably having a $Na_2O/SiO_2$ ratio of about 1/2.2 to about 1/2.8.

The detergent active materials used in the compositions of the present invention must be stable in the presence of chlorine bleach, especially hypochlorite bleach, and preferably comprise those of the anionic, amino oxide, phosphine oxide, sulfoxide or betaine water-dispersible surfactant types with the first-mentioned anionics being most preferred. The detergent active materials are used in amounts ranging of from about 0.1% to about 5%, preferably about 0.5% to about 2% by weight, more preferably from about 0.3% to about 0.9% by weight. Particularly preferred surfactants herein are the linear or branched alkali metal mono- and/or di-($C_8$–$C_{14}$) alkyl diphenoloxide mono- and/or disulfonates, commercially available, for example, as DOWFAX TM 3B-2 and DOWFAX TM 2A-1. Other suitable surfactants include the primary alkyl sulfates, alkylaryl sulfonates and sec-alkyl sulfates. Examples are sodium $C_{10}$–$C_{18}$ alkyl sulfates, such as sodium dodecylsulfate and sodium tallow alcohol-sulfate; sodium $C_{10}$–$C_{18}$ alkanesulfonates, such as sodium, hexadecyl-1-sulfonate; and sodium $C_{12}$–$C_{18}$ alkyl benzene sulfonates, such as sodium dodecylbenzenesulfonate. The corresponding potassium salts may also be employed.

As other suitable surfactants or detergent active materials, the amine oxide surfactants are typically of the structure $R_2R'NO$ in which each R represents a lower alkyl group, for instance, methyl, and R' represents a long chain alkyl group having from 8–22 carbon atoms, for instance a lauryl, myristyl, palmityl or cetyl group. Instead of an amine oxide, a corresponding surfactant phosphene oxide $R_2R'PO$ or sulfoxide RR'SO may be employed. Betaine surfactants are typically of the structure $R_2R'N^+R''COO^-$, in which each R represents a lower alkyl group having from 1–5 carbon atoms. Specific examples of these surfactants are lauryl dimethyl amine oxide, myristyl dimethyl amine oxide, the corresponding phosphine oxides and sulfoxides, and the corresponding betaines, including dimethyl ammonium acetate, tetradecyl-diethylammonium pentanoate, hexadethyldimethyl ammonium hexonate and the like. Surfactants of the foregoing type, all well known in the art, are described, for example, in U.S. Pat. Nos. 3,985,668 and 4,271,030.

Although any chlorine bleach compound, such as dichloro-isocyanurate, dichloro-dimethyl hydantoin, or chlorinated, TSP may be employed in the compositions of this invention, alkali metal, e.g., potassium, lithium, magnesium and especially sodium, hypochlorite is preferred. The composition should contain sufficient chlorine bleach compound to provide about 0.2% to about 4% by weight of available chlorine, as determined, for example, by acidification of a hundred parts of the composition with excess hydrochloric acid. A solution containing about 0.2% to 4.0% by weight of sodium hypochlorite contains or provides roughly the same percentage of available chlorine. About 0.8% to about 1.6% by weight of available chlorine is especially preferred.

Generally, effectiveness of ADL's is directly related to (a) available chlorine levels, (b) alkalinity, (c) solubility in washing medium, and (d) foam inhibition. Accordingly, it is preferred that the pH of the ADL composition be at least about 9.5, more preferably from about 10.5 to 13.5, and most preferably at least about 11.5. At relatively lower pH values, the ADL product is too viscous, i.e., solid-like, and thus not readily fluidized under the sheer force levels created within the dispenser cup under normal machine operating conditions. In essence, the composition loses much, if not all, of its thixotropic character. The addition of an alkali metal hydroxide such as sodium hydroxide is often needed to increase the pH to within the above ranges, and to increase flowability properties. The presence of an alkali metal carbonate, such as sodium carbonate, is also often needed, since it acts as a buffer serving to maintain the desired pH level. Alkali metal hydroxides, such as sodium hydroxide, serve the further function of neutralizing the phosphoric or phosphonic acid ester foam depressant when present. Generally speaking, about 0.5% to about 3% by weight of the alkali metal hydroxide, such as sodium hydroxide, and from about 2% to about 9% by weight of the alkali metal carbonate, such as sodium carbonate, is present in the composition.

The amount of water contained in the compositions of the present invention should be neither so high as to produce unduly low viscosity and fluidity, nor so low as to produce unduly high viscosity and low flowability, which in either case diminish or destroy the thixotropic properties. The amount of water is readily determined by routine experimentation in any particular instance. Generally, however, the amount of water will range from about 20% to about 70% by weight. Preferably, the water employed should be deionized or softened.

The compositions of the present invention exhibit excellent cup retention properties when compared with commercially available ADL's. While the use of an alumina dispersion alone as a thixotrope does not give the desired cup retention properties, the incorporation, with the alumina thixotrope, of a long chain fatty acid, the metal salt of a long chain fatty acid or mixtures thereof unexpectedly provides ADL's which exhibit excellent cup retention properties. The preferred long chain fatty acids are the higher aliphatic fatty acids having from about 8 to about 22 carbon atoms, more preferably from about 10 to about 20 carbon atoms, and especially from about 12 to about 18 carbon atoms, inclusive of the carbon atom of the carboxyl group of the fatty acid. The aliphatic radical may be saturated or unsaturated and may be straight or branched chain. Mixtures of fatty acids may be used such as those derived from natural sources, e.g., tallow fatty acid, cocoa fatty acid and soya fatty acid. Non-limiting examples of suitable fatty acids include decanoic acid, dodecanoic acid, palmitic acid, myristic acid, stearic acid, oleic acid, tallow fatty acid, cocoa fatty acid, soya fatty acid, and mixtures of such acids. Stearic acid, in view of its commercial availability, is especially preferred.

In addition to, or alternatively to, the long chain fatty acids mentioned above, the compositions of the present invention may include as a stabilizing agent, metal salts of such acids. Although the fatty acid salts of monovalent metals, e.g., sodium and potassium, may be employed, it is especially preferred to use the polyvalent metal salts of the long chain fatty acids mentioned above, especially those of Groups IIA, IIIA, IVA, VA, VIA, VIIA, IIB, IIIB, IVB, VB and VIII of the Periodic Table of Elements. Especially preferred are the aluminum salts of the long chain fatty acids mentioned above. Especially preferred as a stabilizing agent is aluminum stearate, i.e., aluminum tristearate.

The amount of the stabilizing agent employed will depend upon such factors as the nature of the fatty acid and/or fatty acid salt, the nature and amount of the alumina dispersion, the amount and type of detergent active compound, inorganic salts and builders present as well as such factors as shipping and storing conditions. Generally, however, the amount of the stabilizing agent, i.e., the long chain fatty acid, the metal salt of the long chain fatty acid or mixture thereof, will be in the range of from about 0.2% to about 2%, preferably from about 0.6% to about 1.5%.

Although the prior art, as exemplified by British Patent No. 2,176,495, suggests that the preferred method of forming ADL's is to first dissolve or disperse all of the inorganic salts, e.g., carbonate (when employed), silicate and polyphosphate, in the aqueous medium, followed by cooling and the addition of the bleach, surfactant, fatty acid salt stabilizer and thickener, it has been found that using the thickener of the present invention, i.e., alumina dispersions, it is preferred that the alumina dispersion be added and mixed together with the inorganic salts, followed by cooling and the addition of the bleach and surfactant. It has been found, as is typical of ADL's, that when the inorganic salts are dispersed in the aqueous medium, the mixture becomes quite viscous. It has been surprisingly found that by adding the alumina dispersion together with the inorganic salts the mixture remains relatively fluid, thus making it easier to mix. Accordingly, in the method of the present invention, the inorganic salt and the alumina dispersion are first mixed, followed by cooling and the addition of the bleach and surfactant, the stabilizing agent, i.e., the long chain fatty acid or metal salt thereof, being added prior to or subsequent to the cooling step.

It will be recognized that other conventional ingredients may be included in the compositions of the present invention, such ingredients including perfumes, hydrotropic agents, such as the sodium benzene, toluene, xylene and cumene sulfonates, preservatives, dyestuffs and pigments and the like, all of course being stable to chlorine bleach compound and high alkalinity.

The ADL compositions of the present invention are readily employed in a known manner for washing dishes, other kitchen utensils and the like in an automatic dishwasher provided with a suitable detergent dispenser in an aqueous wash bath containing an effective amount of the composition.

EXAMPLES

To more fully illustrate the present invention, the following non-limiting examples are presented. In the examples which follow, the components were mixed in the order shown with a Ross Model 100-L ½ horsepower mixer equipped with a slotted head. The mixer setting was adjusted throughout the experiments to maintain good mixing. In all cases, the alumina dispersion was prepared previously by stirring, at room temperature, for about ten minutes, a mixture of 18.0 grams of Catapal® D alumina marketed by Vista Chemical Company, 89.2 grams of deionized water, and 12.8 grams of 0.1 N HCl. The comparative clay dispersion was prepared previously by stirring, at room temperature, for about ten minutes, a mixture of 18.0 grams of GELWHITE GP clay and 102 grams of deionized water. The addition of sodium hydroxide and sodium tripolyphosphate was exothermic, and in all cases mixing was performed at 50°-60° C., except where otherwise noted.

COMPARATIVE EXAMPLE

Comparative Example 1
An ADL composition was prepared as above having the following components:

| Component | Amount (g) |
|---|---|
| Deionized water | 140.0 |
| Sodium hydroxide (50%) | 14.4 |
| Sodium carbonate | 42.0 |
| Sodium silicate (50%) | 82.4 |
| Sodium tripolyphosphate (anhydrous) | 96.3 |

Following cooling to 25°-30° C., the following components were added:

| Component | Amount |
|---|---|
| Sodium hypochlorite (2.5% | 60.0 |

-continued

| Component | Amount |
|---|---|
| available chlorine) | |
| Alumina dispersion | 120.0 |
| DOWFAX TM 3B-2 | 4.8 |

EXAMPLE 2

A second ADL composition was prepared using the procedure of Example 1 with the exception that the alumina dispersion was added together with the inorganic salts and prior to cooling. The ADL prepared had the following composition:

| Component | Amount (g) |
|---|---|
| Dionized water | 140.0 |
| Sodium hydroxide (50%) | 14.4 |
| Stearic acid | 6.0 |
| Sodium carbonate | 42.0 |
| Alumina dispersion | 120.0 |
| Sodium silicate (50%) | 82.4 |
| Sodium tripolyphosphate (anhydrous) | 96.3 |

The above mixture was cooled to 25°-30° C. and the following components added:

| Component | Amount (g) |
|---|---|
| Sodium hypochlorite (2.5% available chlorine) | 60.0 |
| DOWFAX TM 3B-2 | 4.8 |

EXAMPLE 3

A third ADL composition was prepared using the procedure of Example 2. The ADL had the following composition:

| Component | Amount (g) |
|---|---|
| Deionized water | 140.0 |
| Sodium hydroxide (50%) | 14.4 |
| Stearic acid | 6.0 |
| Sodium carbonate | 42.0 |
| Alumina dispersion | 120.0 |
| Sodium silicate (50%) | 82.4 |
| Sodium tripolyphosphate (anhydrous) | 96.3 |

The above mixture was cooled to 25°-30° C. and the following components added:

| Component | Amount (g) |
|---|---|
| Sodium hypochlorite (2.5% available chlorine) | 60.0 |
| DOWFAX TM 3B-2 | 4.8 |
| Aluminum stearate | 3.0 |

RHEOLOGICAL COMPOSITION

The samples prepared in Examples 1-3 were evaluated on a Carri-Med CS-100 Controlled Stress rheometer with a 4 cm parallel plate sensor. Each sample was pre-sheared at 1500 $sec^{-1}$ to simulate the shearing experienced in dispensing a sample from a commercial sample container. Rheological Rheological results are shown in the FIGURE. It can be seen that the unmodified alumina formulation has a very low yield value and a low viscosity compared to the stearic acid modified alumina formulation of Example 2. Also, the stearic acid modified formulation has very nearly the same viscosity and yield characteristics of the sample of "Liquid Palmolive", which is representative of commercially available clay containing formulations. The alumina formulation of Example 3 modified with both stearic acid and aluminum stearate, has a greater viscosity and yield value than that of the commercial product, i.e., Liquid Palmolive.

CUP RETENTION TEST

Dishwasher cup retention tests were conducted with a "Whirlpool Super Scour Custom Supreme" dishwasher containing a worn dispensing cup seal. The tests were conducted using the "High Temperature Washing" option on the "Normal Heavy" cycle. The second dispensing cup was filled with the ADL, and the weight recorded. The wash cycle was then interrupted after 14-15 minutes, just prior to the cup opening. The cup was refilled with the same detergent and the amount required to refill the cup was recorded. The results of testing the formulations of Examples 1-3 and three commercially available products are given below.

| Formulation | Fill Wt. (g) | Refill Wt. (g) | % Retention |
|---|---|---|---|
| Example 1 | 89.4 | 89.4 | 0 |
| Example 2 | 96.5 | 11.3 | 88.3 |
| Example 3 | 95.0 | 0 | 100.0 |
| Palmolive | 104.6 | 88.8 | 15.1 |
| Cascade | 103.8 | 98.2 | 5.8 |
| Sunlight | 113.4 | 105.3 | 7.1 |

As can be seen, use of alumina dispersion alone results in a product having no cup retention ability, due to insufficient gel strength. However, the products employing alumina dispersions which are modified with stearic acid (Example 2) or with stearic acid and aluminum stearate (Example 3) show much better cup retention than commercially available formulations which utilize clay-based thickeners.

COMPARATIVE EXAMPLE 4

A fourth ADL composition was prepared as above having the following components:

| Component | Amount (g) |
|---|---|
| Deionized water | 80.0 |
| Sodium hypochlorite (5% available chlorine) | 60.0 |
| Sodium hydroxide (50%) | 14.4 |

At this point, the mixture was heated to 50° C. and maintained at 50°-60° C. as the following additional components were added:

| Component | Amount (g) |
|---|---|
| Sodium carbonate | 42.0 |
| Sodium silicate (50%) | 82.4 |
| Alumina dispersion | 120.0 |
| Sodium tripolyphosphate (anhydrous) | 96.3 |

At this point, the temperature was maintained at 50°-60° C. for ten minutes of additional mixing. The temperature was then allowed to fall to about 40° C. as the following components were added:

| Component | Amount (g) |
|---|---|
| Sodium hypochlorite (5% available chlorine) | 60.0 |
| Stabilizing agent, if any | 0.0 |
| DOWFAX TM 3B-2 | 4.8 |

EXAMPLE 5

A fifth ADL composition was prepared using the procedure of Example 4 with the exception that 6.0 grams of stearic acid was added as the stabilizing agent.

EXAMPLE 6

A sixth ADL composition was prepared using the procedure of Example 4 with the exception that 6.0 grams of aluminum stearate was added as the stabilizing agent.

COMPARATIVE EXAMPLE 7

A seventh ADL composition was prepared as above having the following components:

| Component | Amount (g) |
|---|---|
| Deionized water | 80.0 |
| Sodium hypochlorite (5% available chlorine) | 60.0 |
| Sodium hydroxide (50%) | 14.4 |

At this point, the mixture was heated to 50° C. and maintained at 50°-60° C. as the following additional components were added:

| Component | Amount (g) |
|---|---|
| Sodium carbonate | 42.0 |
| Sodium silicate (50%) | 82.4 |
| Clay dispersion | 120.0 |
| Sodium tripolyphosphate (anhydrous) | 96.3 |

At this point, the temperature was maintained at 50°-60° C. for ten minutes of additional mixing. The temperature was then allowed to fall to about 40° C. as the following components were added:

| Component | Amount (g) |
|---|---|
| Sodium hypochloride (5% available chlorine) | 60.0 |
| Stabilizing agent, if any | 0.0 |
| DOWFAX TM 3B-2 | 4.8 |

COMPARATIVE EXAMPLE 8

An eighth ADL composition was prepared using the procedure of Example 7 with the exception that 6.0 grams of aluminum stearate was added as the stabilizing agent.

PERFORMANCE TEST

A selection of clear glass tumblers and china plates were soiled in a standardized fashion as a precursor to automatic dishwasher testing. The tumblers were soiled by dipping them in a solution of 50% vegetable shortening and 50% hexane. After evaporation of the hexane, each tumbler was left with a uniform, greasy film. The plates were soiled by adding 5 ml of a mixture of 3 eggs and approximately 2 cups flour and 2 water. This protein/starch mixture was uniformly spread over the plates, and the plates were then oven dried at 60° C. for 30 minutes to give a dried protein/starch residue.

These soiled tumblers and plates were then washed in a KitchenAid Superba automatic dishwasher, set on the short wash cycle. The formulations of Examples 4–8 were tested against two commercially available products from major producers of household cleaning products.

The removal of the protein/starch mixture was excellent in all cases. All plates were judged to be completely clean, regardless of the formulation tested. There was no difference between the cleaning performance observed with any of these experimental formulations or with the commercially available products. The tumblers were likewise completely cleansed of all greasy residue, regardless of the formulations or product tested. There were subtle differences in the amount and type of spotting or filming residues on the tumblers. The spotting or filming was not greasy in nature, and was judged to be a result of some interaction between the thickener package and the rinsing section of the dishwasher. Overall spotting and filming was visually ranked on a scale of 0 (very poor) to 5 (totally spot and film free). The rankings obtained with the formulations of Examples 4–8 and the commercial products are given below:

| Formulation | Ranking |
|---|---|
| 4 | 2 |
| 5 | 3 |
| 6 | 4 |
| 7 | 3 |
| 8 | 4 |
| Commercial Formulation 1 | 3 |
| Commercial Formulation 2 | 3 |

These results show that the formulations of this invention (Examples 5 and 6) give good cleaning performance in typical automatic dishwasher conditions.

CUP RETENTION TEST

Cup retention tests were preformed on the formulations of Examples 4–8 using the procedure described above. Cup retention was measured in duplicate. Average results are given below:

| Formulation | Cup Retention |
|---|---|
| 4 | 1.4% |
| 5 | 24.0% |
| 6 | 98.8% |
| 7 | 4.4% |
| 8 | 94.4% |

These results demonstrate the significant impact of the various additives on cup retention of both clay and alumina based formulations. Alumina modified with aluminum stearate showed the largest improvement in cup retention. Alumina modified with stearic acid also gave a significant increase in cup retention. These results also show that clays can be improved with stearic acid. The cup retention of the unmodified clay appears to be greater than that of the unmodified alumina, but neither product is acceptable in this particular dishwasher. These results show that the modified alumina thickener of this invention is an effective liquid automatic dishwashing detergent with good cup retention properties.

The foregoing description of the invention has been directed in primary part to a particular preferred embodiment in accord with the requirements of the patent statutes and for purposes of explanation and illustration. However, it is Applicant's intention in the following claims to cover all modifications and variations as fall within the true spirit and scope of the invention.

What is claimed is:

1. In an aqueous, thioxtropic automatic dishwasher composition containing from about 20% to about 70% by weight water, from about 2.5% to about 20% by weight sodium silicate, from about 8% to about 33% by weight of an alkali metal polyphosphate, an amount of a chlorine bleach compound sufficient to provide about 0.2% to about 4% by weight of available chlorine and from about 0.1% to about 5% by weight of a bleach stable, water-dispersible organic detergent active material, the improvement comprising a thickener comprised of from about 15% to about 35% by weight of an aqueous alumina dispersion and from about 0.2% to about 2% by weight of a stabilizer comprising a mixture of a long chain fatty acid and the polyvalent metal salt of a long chain fatty acid.

2. The composition of claim 1 wherein said thickener is present in an amount of from about 15% to about 35% by weight.

3. The composition of claim 1 wherein said polyvalent metal salt comprises aluminum stearate.

4. The composition of claim 1 wherein the stabilizing agent comprises a polyvalent metal salt of stearic acid and stearic acid.

5. The composition of claim 4 wherein said polyvalent metal comprises aluminum.

6. The composition of claim 1 further including an alkali metal carbonate.

7. The composition of claim 6 wherein said alkali metal carbonate is present in an amount of from about 2% to about 9% by weight.

8. The composition of claim 7 wherein said alkali metal carbonate comprises sodium carbonate.

9. The composition of claim 1 further including an alkali metal hydroxide.

10. The composition of claim 9 wherein said alkali metal hydroxide is present in an amount of from about 0.5% to about 3% by weight.

11. The composition of claim 10 wherein said alkali metal hydroxide comprises sodium hydroxide.

12. The composition of claim 1 further including a chlorine bleach stable foam depressant.

13. The composition of claim 1 wherein said chlorine bleach compound provides about 0.8% to about 1.6% by weight of available chlorine.

14. The composition of claim 13 wherein said chlorine bleach compound comprises an alkali metal hypochlorite.

15. The composition of claim 14 wherein said alkali metal hypochlorite comprises sodium hypochlorite.

16. A composition for thickening automatic dishwasher liquids comprising from about 15% to about 35% by weight of an aqueous alumina dispersion and from about 0.2% to about 2% by weight of a stabilizer comprising a mixture of a long chain fatty acid and the polyvalent metal salt of a long chain fatty acid.

* * * * *